US010092811B2

(12) United States Patent
Kim

(10) Patent No.: US 10,092,811 B2
(45) Date of Patent: Oct. 9, 2018

(54) SMART PUTTER FOR GOLF CLUB

(71) Applicant: IdeaLink, Inc., Seoul (KR)

(72) Inventor: Jong Min Kim, Seoul (KR)

(73) Assignee: IdeaLink, Inc., Seoul (KR)

( * ) Notice: Subject to any disclaimer, the term of this patent is extended or adjusted under 35 U.S.C. 154(b) by 0 days.

(21) Appl. No.: 15/273,654

(22) Filed: Sep. 22, 2016

(65) Prior Publication Data

US 2018/0071608 A1 Mar. 15, 2018

(30) Foreign Application Priority Data

Sep. 13, 2016 (KR) ..... 10-2016-0117856

(51) Int. Cl.
*A63B 69/36* (2006.01)
*A63B 24/00* (2006.01)
*A63B 53/00* (2015.01)

(52) U.S. Cl.
CPC ..... *A63B 69/3685* (2013.01); *A63B 24/0021* (2013.01); *A63B 53/007* (2013.01)

(58) Field of Classification Search
CPC ..... A63B 69/3632; A63B 69/3685
See application file for complete search history.

(56) References Cited

U.S. PATENT DOCUMENTS 5,082,276 A * 1/1992 Stevens ..... A63B 69/3685 473/223
5,160,142 A * 11/1992 Marshall ..... A63B 69/3685 473/241
5,707,296 A * 1/1998 Hodgson ..... A63B 69/3614 473/220
5,792,001 A * 8/1998 Henwood ..... A63B 69/3685 473/220
8,435,130 B2 * 5/2013 Cheresko ..... A63B 69/3614 473/257
2002/0123386 A1 * 9/2002 Perlmutter ..... A63B 24/0021 473/223
2003/0207718 A1 * 11/2003 Perlmutter ..... A63B 24/0021 473/221
2004/0092327 A1 * 5/2004 Marnocha ..... A63B 69/3614 473/220
2008/0096683 A1 * 4/2008 Salmon ..... A63B 69/3685 473/251
2009/0137333 A1 * 5/2009 Lin ..... A63B 69/3685 473/233

(Continued)

FOREIGN PATENT DOCUMENTS

KR 20-0299178 Y1 12/2002
KR 20-0410188 Y1 3/2006

*Primary Examiner* — Jay Liddle
*Assistant Examiner* — Alex R. R. P. Rada, III
(74) *Attorney, Agent, or Firm* — Studebaker & Brackett PC

(57) ABSTRACT

Disclosed is a smart putter for a golf club including a putter head having a putting surface for putting a golf ball on one side thereof, a swing detecting unit that is provided in the putter head to detect a balance degree of the putter head, a communication module that is provided in the putter head to transmit balance degree data of the putter head detected by the swing detecting unit to an external device, and a control unit that stores the balance degree data of the putter head detected by the swing detecting unit and transmits the balance degree data to the communication module.

9 Claims, 5 Drawing Sheets

(56) References Cited

U.S. PATENT DOCUMENTS

| | | | | |
|---|---|---|---|---|
| 2009/0163285 | A1* | 6/2009 | Kwon | A63B 24/0021 473/223 |
| 2013/0252751 | A1* | 9/2013 | Bittner | A63B 69/3614 473/220 |
| 2016/0236059 | A1* | 8/2016 | Sato | A63B 69/3685 |
| 2016/0236060 | A1* | 8/2016 | Sato | G09B 19/0038 |

* cited by examiner

SMART PUTTER FOR GOLF CLUB

CROSS-REFERENCE TO RELATED APPLICATIONS

A claim for priority under 35 U.S.C. § 119 is made to Korean Patent Application No. 10-2016-0117856 filed Sep. 13, 2016 in the Korean Intellectual Property Office, the entire contents of which are hereby incorporated by reference.

BACKGROUND

Embodiments of the inventive concept described herein relate to a smart putter for a golf club, and more particularly to an internet of things (IoT) based smart putter for a golf club, by which a putting motion may be scientifically exercised while the user identifies a horizontality, a balance, and a straightness of a putter head.

In general, various forms of woods, irons, and putters are used according to distance and conditions, including tee shots, in golf games, and among them, the putter is the most important golf club that determines a score in the field and is used to put a golf ball into a hole cup on the greed field.

Accordingly, because the putting is a shot that is made while distance and direction are determined with a sense, for example, of a part of a hand of the user, it is considerably difficult and important as well to select a putter, and the most desirable putting may be made only when the apex of a golf ball and a sweet spot of the head of the putter coincide with each other.

Further, if the sweet point of the head of the putter and the apex of the golf ball do not coincide with each other or transfer of a force is not adjusted according to operation times of the golf ball and the golf putter when a golf ball is to be put by using a putter, the golf ball occasionally is not moved along an intended locus because it deviates the locus. That is, it is most important to maintain the balance and swing straightness of the putter head during a putting motion.

Meanwhile, in recent years, putting exercises using screen golfs that are virtual golf systems have been increasingly made.

Although a putting training system according to the related art achieves putting training as a result of the movement to a hole cup by striking a golf ball on a mat or a green field, it merely corresponds to conjecture of a suitableness of a swing as a result instead of analysis of the putting. That is, the putting training is not scientific and requires a long time until the putting becomes sophisticated, and various results may be obtained according to conditions.

Accordingly, the applicant has invented an internet of things (IoT) based smart putter for a golf club, which avoids simple repetitive putting training using a green field or a putting training device according to the related art and by which a putting motion may be scientifically exercised while the user identifies a horizontality, a balance, and a straightness of a putter head.

SUMMARY

Embodiments of the inventive concept provide a smart putter for a golf club, by which a putting motion may be exercised while a balance maintenance and a swing straightness of a putter head are improved during a putting motion.

Embodiments of the inventive concept also provide provides a smart putter for a golf club by which a swing motion may be exercised and corrected without being restricted by time and places.

In accordance with an aspect of the inventive concept, there is provided a smart putter for a golf club including a putter head having a putting surface for putting a golf ball on one side thereof, a swing detecting unit that is provided in the putter head to detect a balance degree of the putter head, a communication module that is provided in the putter head to transmit balance degree data of the putter head detected by the swing detecting unit to an external device, and a control unit that stores the balance degree data of the putter head detected by the swing detecting unit and transmits the balance degree data to the communication module.

Here, the smart putter may further include a display unit that is provided in the putter head to display the balance degree data of the putter head detected by the swing detecting unit.

The display unit may include a plurality of LED lamps that are provided in the putter head along an X axis direction that is parallel to a putting surface of the putter head and an Y axis direction that is perpendicular to the putting surface at an interval.

The smart putter may further include a laser diode that is provided in the putter head to irradiate a laser beam along a swing locus of the putter head.

The smart putter may further include a light path part that is formed in the putter head to pass through the putting surface of the putter head and to guide irradiation of the laser beam irradiated from the laser diode.

The smart putter may further include at least one battery that is provided in the putter head to supply electric power to the swing detecting unit, the communication module, and the control unit.

The smart putter further include a charging terminal that is provided in the putter head to charge the at least one battery.

The smart putter further include a switch that is provided in the putter head to switch on or off supply of electric power of the at least one battery.

The at least one battery may include a pair of batteries that are provided to be symmetrical to each other with respect to the putter head while a center line that is perpendicular to the putting surface at the center of the putting surface being interposed therebetween.

The swing detecting unit may include at least one of a nine axis motion sensor, an inertial moment unit (IMU) sensor, a gyro sensor, an accelerometer sensor, and a compass.

In accordance with another aspect of the inventive concept, there is provided a smart putter for a golf club including a putter head having a putting surface for putting a golf ball on one side thereof, a swing detecting unit that is provided in the putter head to detect a balance degree of the putter head, and a communication module that is provided in the putter head to transmit balance degree data of the putter head detected by the swing detecting unit to an external device.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
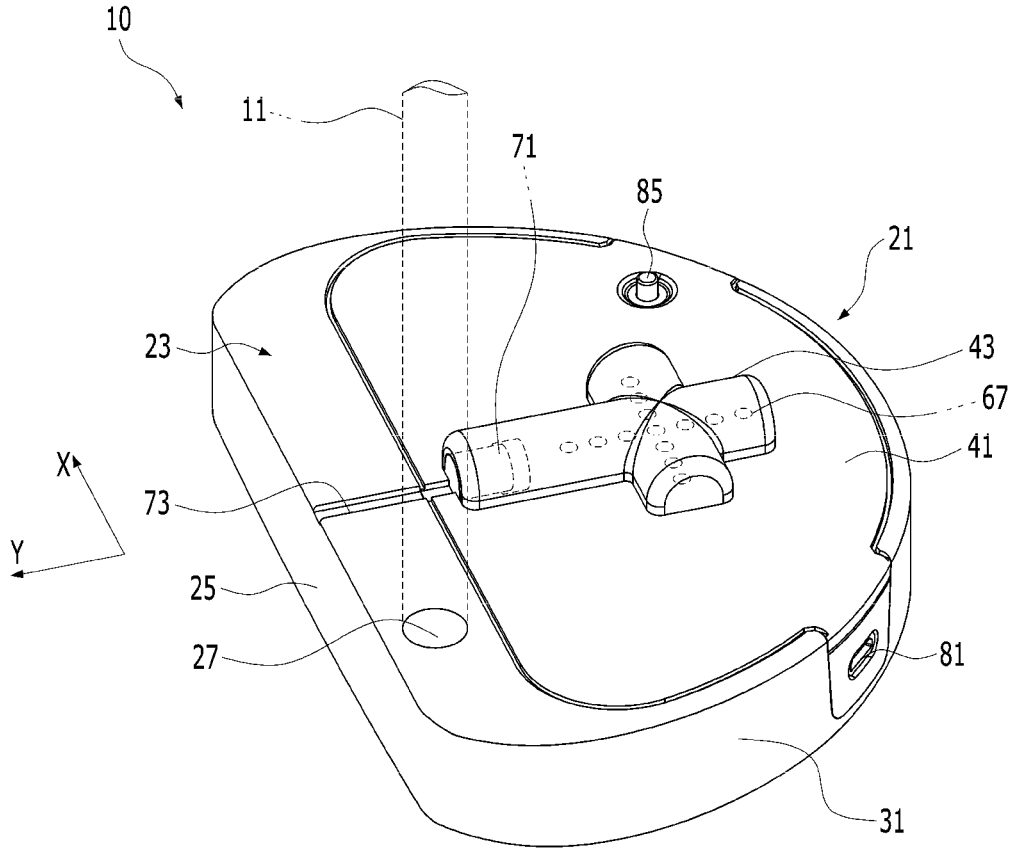
FIG. 1 is a perspective view of a smart putter for a golf club according to an embodiment of the inventive concept.
Figure 2:
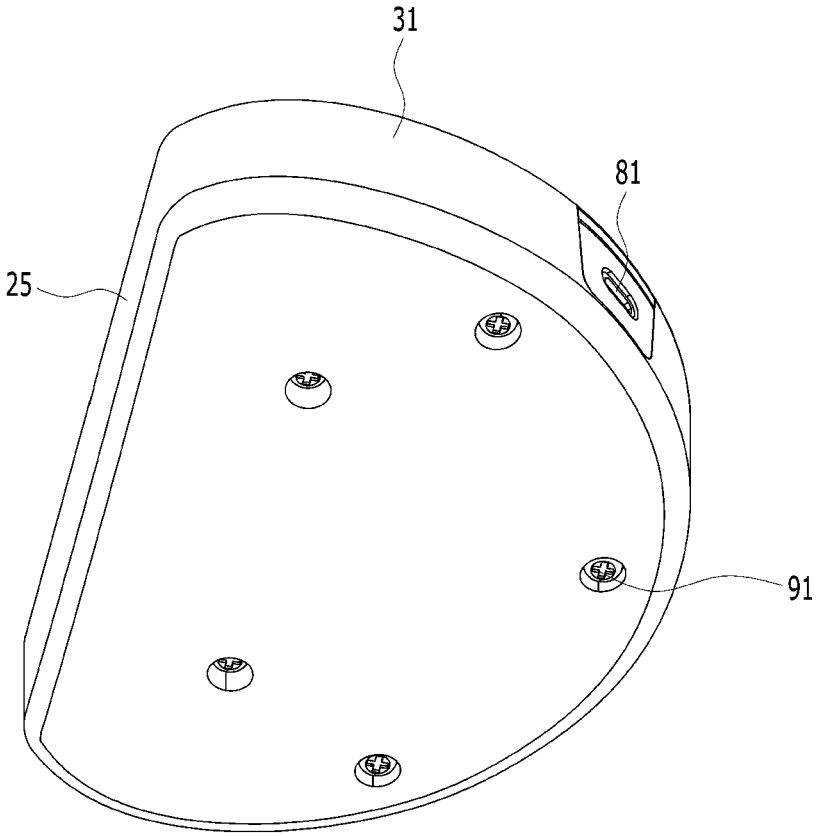
FIG. 2 is a bottom perspective view of FIG. 1.
Figure 3:
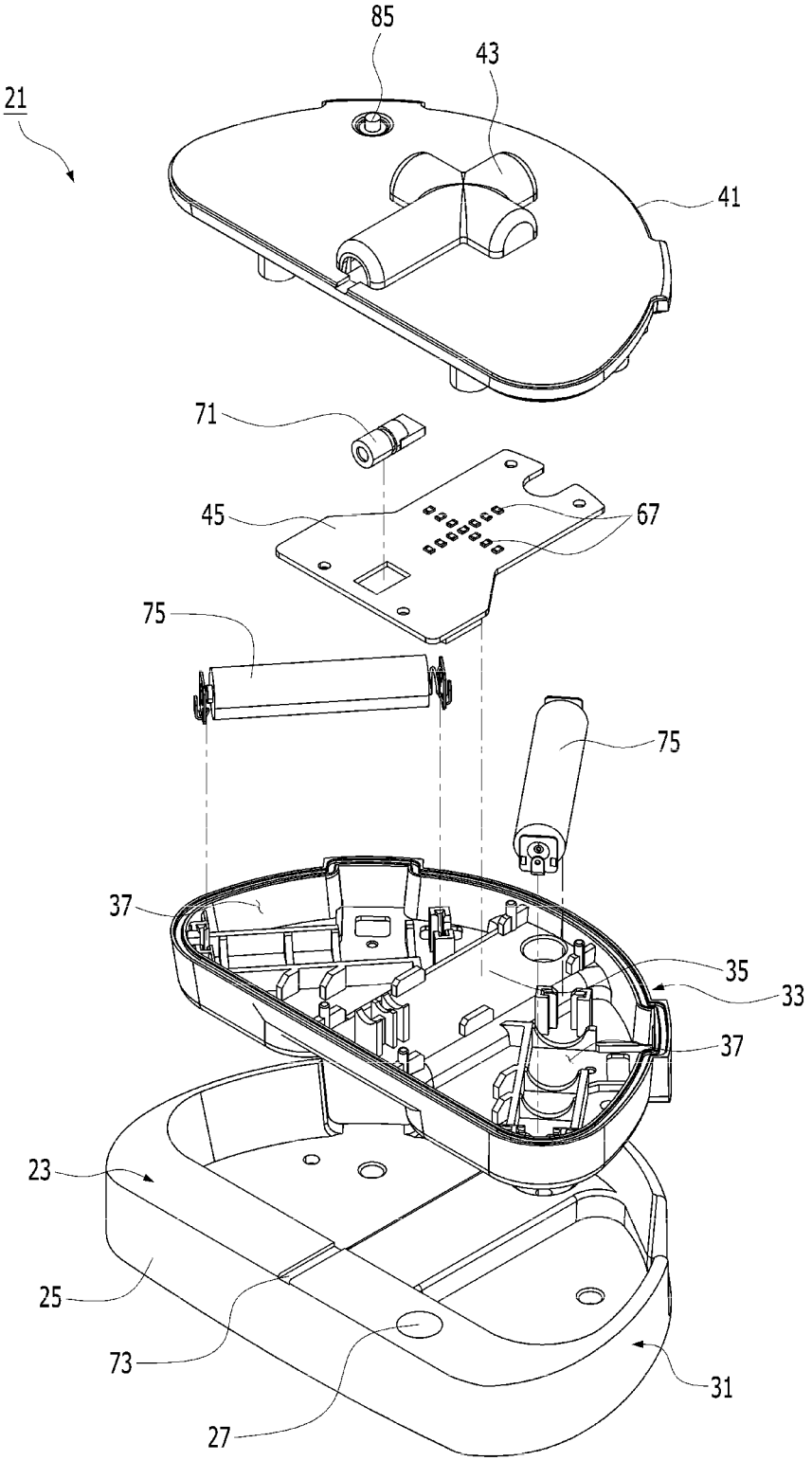
FIG. 3 is a partial exploded perspective view of FIG. 1.
Figure 4:
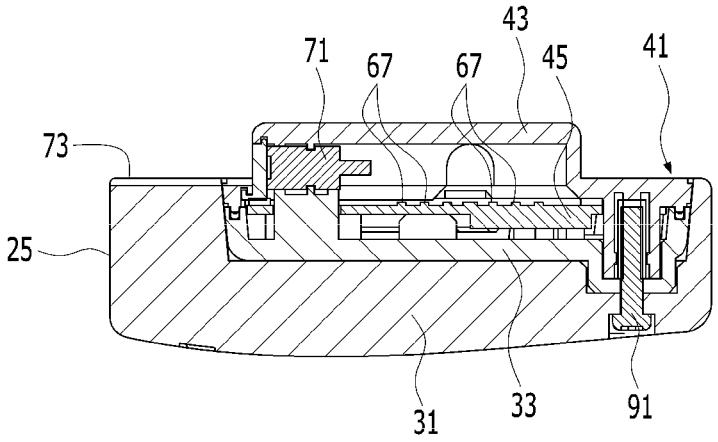
FIG. 4 is a longitudinal sectional view of FIG. 1.
Figure 5:
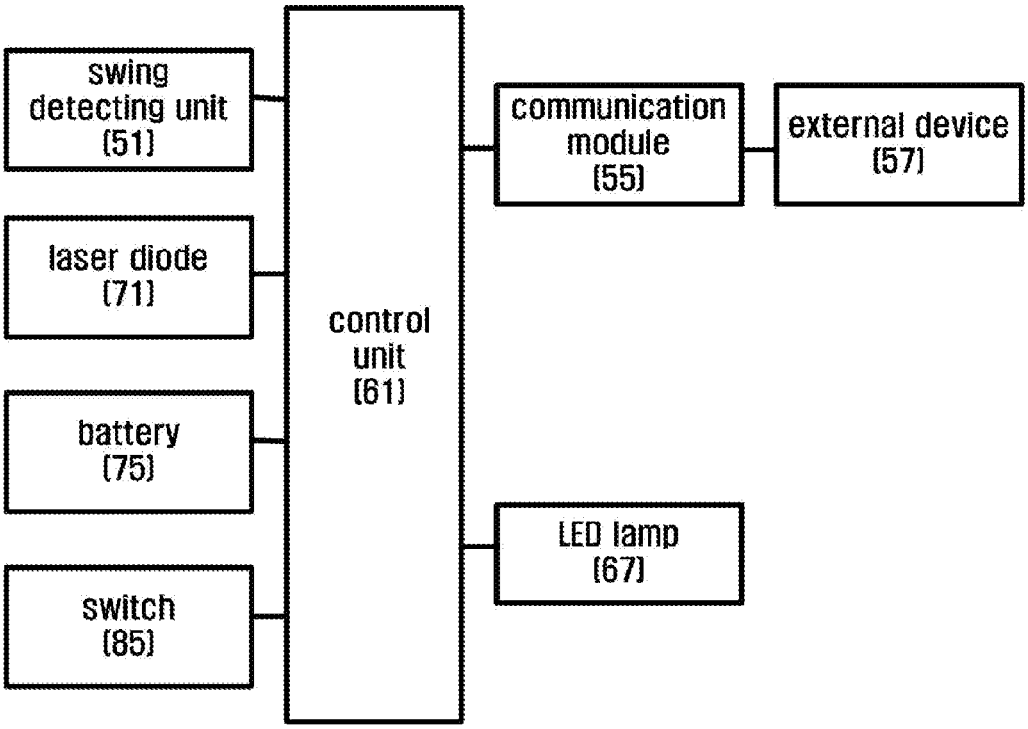
FIG. 5 is a control block diagram of a smart putter for a golf club according to an embodiment of the inventive concept.

The above and other aspects, features and advantages of the invention will become apparent from the following description of the following embodiments given in conjunction with the accompanying drawings. However, the inventive concept is not limited to the embodiments disclosed below, and may be implemented in various forms. The embodiments of the inventive concept is provided to make the disclosure of the inventive concept complete and fully inform those skilled in the art to which the inventive concept pertains of the scope of the inventive concept.

The terms used herein are provided to describe the embodiments but not to limit the inventive concept. In the specification, the singular forms include plural forms unless particularly mentioned. The terms "comprises" and/or "comprising" used herein does not exclude presence or addition of one or more other elements, in addition to the aforementioned elements. Throughout the specification, the same reference numerals denote the same elements, and "and/or" includes the respective elements and all combinations of the elements. Unless otherwise defined, all terms (including technical and scientific terms) used herein have the same meaning as commonly understood by those skilled in the art to which the inventive concept pertains. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein.

Hereinafter, the inventive concept will be described in detail with reference to the accompanying drawings.

FIGS. 1 to 5 illustrate a smart putter for a golf club according to an embodiment of the inventive concept.

As illustrated in the drawings, the smart putter 10 for a golf club according to the embodiment of the inventive concept includes a shaft 11, a putter head 21, a swing detecting unit 51, a communication module 55, and a control unit 61.

The shaft 11 has a thin and long rod shape, and a grip (not illustrated) that may be gripped by the user may be formed at one end of the shaft 11. The shaft 11 is coupled to the putter head 21.

The putter head 21 includes a putting part 23 that has a putting surface 25 for putting a golf ball on one side thereof, and an outer housing 31 which surrounds an opposite side of the putting part 23 in a half moon section shape and of which an upper side is opened.

Hereinafter, as illustrated in FIG. 1, a direction that is parallel to the putting surface 25 of the putter head 21 will be referred to as the X axis direction and a direction that is perpendicular to the putting surface 25 of the putter head 21 will be referred to as the Y axis direction, for convenience of description.

The putting surface 25 of the putting part 23 has a linear section shape, and may have a loft angle. A shaft coupling hole 27, to which the shaft 11 is coupled, is formed on an upper surface of the putting part 23.

An inner housing 33 having an opened-topped hollow can shape is accommodated in the outer housing 31, and the opening of the inner housing 33 is blocked by a cover 41.

The swing detecting part 51, the communication module 55, and the control unit 61 are accommodated in the inner housing 33.

The inner housing 33 includes a circuit board mount 35 on which a circuit board 45 is seated, and a pair of battery receiving parts 37.

The circuit board mount 35 may be provided within the inner housing 33 at the center of the putting surface 25 to be perpendicular to the putting surface 25.

The pair of battery receiving parts 37 may be provided on opposite sides of the inner housing 33 to be symmetrical to each other while the circuit board mount 35 being interposed therebetween. That is, the pair of battery receiving parts 37 may be provided in the inner housing 33 of the putter head 21 to be symmetrical to each other while a center line thereof that is perpendicular to the putting surface 25 at the center of the putting surface 25. Accordingly, when the pair of batteries 75 are received in the battery receiving parts 37, the center of weight of the putter head 21 is prevented from being inclined to one side due to the batteries 75.

Meanwhile, a transparent window 43, for example, having a cross form that protrudes along the X axis direction that is parallel to the putting surface 25 and the Y axis direction that is perpendicular to the putting surface 25 at the center of the putting surface 25 is provided on a surface of the cover 41.

The swing detecting unit 51 is provided in the circuit board 45 that is accommodated in the inner housing 33 of the putter head 21, and detects an inclination of a horizontal surface of the putter head 21, for example, a balance of the putter head 21. The swing detecting unit 51 detects that the putter head 31 is balanced when the putter head 21 is not inclined forwards, rearwards, leftwards, or rightwards with respect to the horizontal surface, and detects a balance degree that indicates an inclination degree when the putter head 21 is inclined forwards, rearwards, leftwards, or rightwards with respect to the horizontal surface. The swing detecting unit 51 may include at least one of a nine axis motion sensor, an inertial moment unit (IMU) sensor, a gyro sensor, an accelerometer sensor, and a compass. Here, the swing detecting unit 51 may be mounted on a surface of the putter head 21 without being accommodated in the inner housing 33 of the putter head 21.

The communication module 55 transmits inclination data of the putter head 21 that is detected by the swing detecting unit 51, for example, balance degree data of the putter head 21 to an external device 57. The communication module 55 is provided in the circuit board 45 that is accommodated in the inner housing 33 of the putter head 21, and is synchronized such that the external device 57 and the smart putter 10 according to the embodiment of the inventive concept perform data communication.

The control unit 61 is provided in the circuit board 45 that is accommodated in the inner housing 33 of the putter head 21. The control unit 61 stores balance degree data of the putter head 21 that is detected by the swing detecting unit 51, and transmits the stored balance degree data to the communication module 55.

Meanwhile, the control unit 61 receives the balance degree data of the putter head 21 detected by the swing detecting unit 51 from the communication module 55 in real time, and provides the received balance degree data to a server or a terminal that is the external device 57. Accordingly, an exercise state of the user and the like may be easily monitored and managed in real time through the external device 57. Here, the balance degree data detected by the swing detecting unit 51 may be directly transmitted to the communication module 55 without passing through the control unit 61.

The smart putter 10 for a golf club according to the embodiment of the inventive concept further includes a display unit that is provided in the putter head 21 to display the balance degree data of the putter head 21 detected by the swing detecting unit 51.

In the embodiment, a plurality of LED lamps 67 may be provided for the display unit. The plurality of LED lamps 67 may be provided in the circuit board 45 such to be arranged along the X axis direction that is parallel to the putting surface 25 of the putter head 21 and the Y direction that is perpendicular to the putting surface 25 at an interval. The plurality of LED lamps 67 are classified into X axis LED lamps and Y axis LED lamps, and are arranged to correspond to a window 43 of the cover 41.

Meanwhile, the plurality of LED lamps 67 are electrically connected to the control unit 61, and emits light to display a balance state of the putter head 21 in the X axis direction and the Y axis direction to the outside through the window 43 of the cover 41 during a swing motion or preparation for a swing motion, based on the balance degree data of the putter head 21 detected by the swing detecting unit 51. For example, if the putter head 21 is balanced with respect to the horizontal surface, an LED lamp that is situated at a cross point at which the X axis and the Y axis of the putter head 21 cross each other is turned on to inform that the putter had 21 is balanced, based on a balance degree data signal detected by the swing detecting unit 51. Further, if the putter head 21 having a plurality of LEDs is inclined forwards, rearward, leftwards, or rightwards with respect to the horizontal surface, for example, in the X axis direction or the Y axis direction of the putter head 21, a plurality of LED lamps are turned on in the X axis direction, the Y axis direction, or in both the X axis and Y axis directions to inform that the putter head 21 is inclined, based on the balance degree data signal detected by the swing detecting unit 51. Accordingly, when the user stands or puts a golf ball for preparation of putting, he or she may visually conveniently identify whether the putter head 21 is balanced, through the plurality of LED lamps 67.

The smart putter 10 for a golf club according to the embodiment of the inventive concept further includes a laser diode 71 that irradiates a laser beam.

The laser diode 71 is provided on one side of the plurality of LED lamps 67 of the circuit board 45 to irradiate a laser beam along a swing locus of the putter head 21.

Meanwhile, the putter head 21 is provided with a light path part 73 that guides the laser beam irradiated from the laser diode 71. The light path part 73 is communicated with the window 43 in the Y axis direction that is perpendicular to the putting surface 25, and is recessed on an upper surface of the putting part 23 to pass through the putting surface 25 of the putting part 23. Accordingly, the laser beam emitted from the laser diode 71 may be emitted to the outside of the putting surface 25 to be perpendicular to the putting surface 25 via the light path part 73.

The laser beam emitted from the laser diode 71 allows the user to visually identify a straightness of a swing of the putter head 21. For example, as a laser beam is irradiated from the laser diode 71 when the user puts a golf ball, the user may visually identify, for example, whether a swing direction displayed on a golf screen and an irradiation direction of a laser beam coincide with each other.

The smart putter 10 for a golf club according to the embodiment of the inventive concept further includes batteries 75.

The batteries 75 are provided in the battery receiving parts 37 of the inner housing 33 of the putter head 21 to supply electric power to the swing detecting unit 51, the communication module 55, and the control unit 61. Further, the batteries 73 supply electric power to the plurality of LED lamps 67 and the laser diode 71.

A pair of symmetrical batteries 75 are received in the battery receiving parts 37 of the inner housing 33 of the putter head 21, respectively.

In this way, because the pair of batteries 75 are received in the battery receiving parts 37 to be symmetrical to each other with respect to the center of the inner housing 33, the weight center of the putter head 21 may be prevented from being inclined to one side due to the batteries 75.

A charging terminal 81 for charging the batteries 75 is provided on a side surface of the putter head 21.

A switch 85 that switches on and off supply of electric power of the battery 75 is provided on an upper side of the putter head 21, for example, on the cover 41.

Here, reference numeral 91 that has not been described denotes a coupling bolt, and denotes a coupling bolt that couples the inner housing 33 and the cover 41.

With the configuration, a process of using the smart putter 10 for a golf club according the embodiment of the inventive concept will be described as follows.

First, the switch 85 is switched on such that electric power of the batteries 75 is supplied to the swing detecting unit 51, the communication module 55, the control unit 61, the plurality of LED lamps 67, and the laser diode 71.

Next, the user grips the shaft 11 and maintains a stance posture.

Then, the swing detecting unit 51 detects an inclination state of the putter head 21, for example, a balance degree of the putter head 21 and transmits the detected balance degree to the control unit 61 in real time.

The control unit 61 stores the balance degree data of the putter head 21 transmitted by the swing detecting unit 51, transmits the balance degree data transmitted by the swing detecting unit 51 to the plurality of LED lamps 67 to display the balance degree data, and transmits the balance degree data to the external device 57 through the communication module 55 as well.

Subsequently, the user visually identifies a balance state of the putter head 21 through the plurality of LED lamps 67, and maintains the balance of the putter head 21 such that the LED lamps 67 situated at the cross point at which the X axis and the Y axis of the putter head 21 cross each other are turned on.

At the same time, the balance of the putter head 21 is maintained such that a laser beam emitted from the laser diode 71 is irradiated towards a hole cup or a target point via the light path part 73 and the putting surface 25.

If the balance state of the putter head 21 is maintained, the user swings.

Meanwhile, if the putter head 21 is inclined to one side during a swing operation of the putter 10, the balance state of the putter head 21 in the X axis direction and the Y axis direction are displayed through the plurality of LED lamps 67, based on the balance degree data of the putter head 21 detected by the swing detecting unit 51. Accordingly, because the plurality of LED lamps 21 are turned on along the X axis direction, the Y axis direction, or both the X axis and Y axis directions if the putter head 21 is not balanced, the user may exercise while visually identifying whether the putter head 21 maintains horizontal and balanced.

Further, because the laser beam emitted from the laser diode 71 is irradiated towards the hole cup or the target point via the light path part 73 and the putting surface 25 during a swing motion of the putter 10, the user may predict a putting direction at a location at which the user strikes a golf ball while viewing the laser beam irradiated from the putter, before a putting motion. Accordingly, if the putting direction and the direction in which the laser beam is irradiated are different, the user may detect the fact and may exercise while visually identifying a straightness of a swing of the putter head 21.

Further, the control unit 61 stores balance degree data of the putter head 21 transmitted from the swing detecting unit 51 in relation to a swing motion of the putter 10 in database, and transmits the stored balance degree data to the external device 57 through the communication module 55.

In this way, according to the inventive concept, an internet of things (IoT) based smart putter for a golf club, by which a putting motion may be scientifically exercised while the user identifies a horizontality, a balance, and a straightness of a putter head, by providing a swing detecting unit that detects a balance degree of the putter head to the putter head and transmitting balance degree data of the putter head detected by the swing detecting unit to an external device through a communication module may be implemented.

Further, a swing motion may be corrected while being exercised regardless of time and place.

According to the inventive concept, a putting motion may be exercised while a balance maintenance and a swing straightness of a putter head are improved during a putting motion. Further, a swing motion may be corrected while being exercised regardless of time and place.

Although the exemplary embodiments of the inventive concept have been described with reference to the accompanying drawings, it will be understood by those skilled in the art to which the inventive concept pertains that the inventive concept can be carried out in other detailed forms without changing the technical spirits and essential features thereof. Therefore, the above-described embodiments are exemplary in all aspects, and should be construed not to be restrictive.

What is claimed is:

1. A smart putter for a golf club comprising:

a putter head having a putting surface for putting a golf ball on one side thereof;

a swing detecting unit that is provided in the putter head to detect a balance degree of the putter head, the balance degree is a degree of parallelization of the putter head with respect to a horizontal plane;

a communication module that is provided in the putter head to transmit balance degree data of the putter head detected by the swing detecting unit to an external device;

a control unit that stores the balance degree data of the putter head detected by the swing detecting unit and transmits the balance degree data to the communication module; and a display unit that displays a parallelization state of the putter head with respect to the horizontal plane by using the balance degree data of the putter head detected by the swing detecting unit, the display unit comprising:

X axis LED lamps that are provided in the putter head along an X axis direction that is parallel to the putting surface of the putter head;

Y axis LED lamps that are provided in the putter head along a Y axis direction that is perpendicular to the putting surface at an interval; and a center LED lamp that is located at a cross point at which the X axis direction and the Y axis direction cross each other, wherein, when the putter head is paralleled with respect to the horizontal plane, only the center LED lamp is turned on to inform that the putter head is balanced, wherein, when the putter head is inclined forwards, rearward, leftwards, or rightwards with respect to the horizontal plane, one or more of the X axis LED lamps are turned on to indicate an incline level of the putter head in the X axis direction, and one or more of the Y axis LED lamps are turned on to indicate an incline level of the putter head in the Y axis direction, and wherein the number of the X axis LED lamps that are turned on is greater as the incline level of the putter head in the X axis direction is greater, and the number of the Y axis LED lamps that are turned on is greater as the incline level of the putter head in the Y axis direction is greater.

2. The smart putter of claim 1, further comprising:

a laser diode that is provided in the putter head to irradiate a laser beam along a swing locus of the putter head.

3. The smart putter of claim 2, further comprising:

a light path part that is formed in the putter head to pass through the putting surface of the putter head and to guide irradiation of the laser beam irradiated from the laser diode.

4. The smart putter of claim 1, further comprising:

at least one battery that is provided in the putter head to supply electric power to the swing detecting unit, the communication module, and the control unit.

5. The smart putter of claim 4, further comprising:

a charging terminal that is provided in the putter head to charge the at least one battery.

6. The smart putter of claim 4, further comprising:

a switch that is provided in the putter head to switch on or off supply of electric power of the at least one battery.

7. The smart putter of claim 4, wherein the at least one battery comprises a pair of batteries that are provided to be symmetrical to each other with respect to the putter head while a center line that is perpendicular to the putting surface at the center of the putting surface being interposed therebetween.

8. The smart putter of claim 1, wherein the swing detecting unit comprises at least one of a nine axis motion sensor, an inertial moment unit (IMU) sensor, a gyro sensor, an accelerometer sensor, and a compass.

9. A smart putter for a golf club comprising:

a putter head having a putting surface for putting a golf ball on one side thereof;

a swing detecting unit that is provided in the putter head to detect a balance degree of the putter head, the balance degree is a degree of parallelization of the putter head with respect to a horizontal plane; and a communication module that is provided in the putter head to transmit balance degree data of the putter head detected by the swing detecting unit to an external device; and a display unit that displays a parallelization state of the putter head with respect to the horizontal plane by using the balance degree data of the putter head detected by the swing detecting unit, the display unit comprising:

X axis LED lamps that are provided in the putter head along an X axis direction that is parallel to the putting surface of the putter head; and Y axis LED lamps that are provided in the putter head along a Y axis direction that is perpendicular to the putting surface at an interval; and a center LED lamp that is located at a cross point at which the X axis direction and the Y axis direction cross each other, wherein, when the putter head is paralleled with respect to the horizontal plane, only the center LED lamp is turned on to inform that the putter head is balanced, wherein, when the putter head is inclined forwards, rearward, leftwards, or rightwards with respect to the horizontal plane, one or more of the X axis LED lamps are turned on to indicate an incline level of the putter head in the X axis direction, and one or more of the Y axis LED lamps are turned on to indicate an incline level of the putter head in the Y axis direction, and wherein the number of the X axis LED lamps that are turned on is greater as the incline level of the putter head in the X axis direction is greater, and the number of the Y axis LED lamps that are turned on is greater as the incline level of the putter head in the Y axis direction is greater.

* * * * *